US005248272A

United States Patent [19]

duPont

[11] Patent Number: 5,248,272

[45] Date of Patent: Sep. 28, 1993

[54] FORWARDS FACING ROWING APPARATUS WITH FEATHERING OF THE OAR BLADES

[76] Inventor: Stephen duPont, 24 N. Casey Key Rd., Osprey, Fla. 34229

[21] Appl. No.: 844,163

[22] Filed: Mar. 2, 1992

[51] Int. Cl.[5] ..... B63H 16/04

[52] U.S. Cl. ..... 440/103; 440/105

[58] Field of Search ..... 440/102, 103; 416/74

[56] References Cited

U.S. PATENT DOCUMENTS

| | | | |
|---|---|---|---|
| 537,616 | 4/1895 | Paar | 440/103 |
| 603,398 | 5/1898 | Dalmer | 440/103 |
| 3,729,369 | 4/1973 | Trull | 440/102 |
| 4,738,643 | 4/1988 | Noggle | 440/103 |

*Primary Examiner*—Jesûs D. Sotelo
*Attorney, Agent, or Firm*—John R. Doherty

[57] ABSTRACT

A forwards facing rowing apparatus wherein the usual pair of sweep hinges is replaced by a single, common axis, sweep hinge system mounted to and rockable with the oarlock mainframe and wherein a blade feathering mechanism including a coupling device such as a pair of swing gears is employed at the oarset including a handle loom and a blade loom, one of the gears being driven from a rotating handle at the in-board end of the handle loom while the mating gear drives or rotates the blade at the outer end of the blade loom. Each gear may be affixed to a rotatable member such as a torque shaft extending along the handle and blade looms and connected at opposite ends to both the handle and blade, respectively. Alternatively, the handle and blade looms may be rotatable members and one of the pair of gears may be attached to each member. The swing gears are arranged to mesh with one another with the generally vertical tangent line of meshing of the gear pitch circles being aligned with the single common sweep hinge axis, allowing the gears to remain in mesh regardless of the large and rapid changes in sweep angularity occurring between the handle and blade looms and also reversing the rotation of feathering at the blade from that at the handle. A linkage assembly is also provided for synchronizing the motion of the handle and blade looms whereby the blade loom is constrained to move in the same direction as that of said handle loom when the handle loom is rotated about the common sweep axis.

36 Claims, 10 Drawing Sheets

FIG. 3
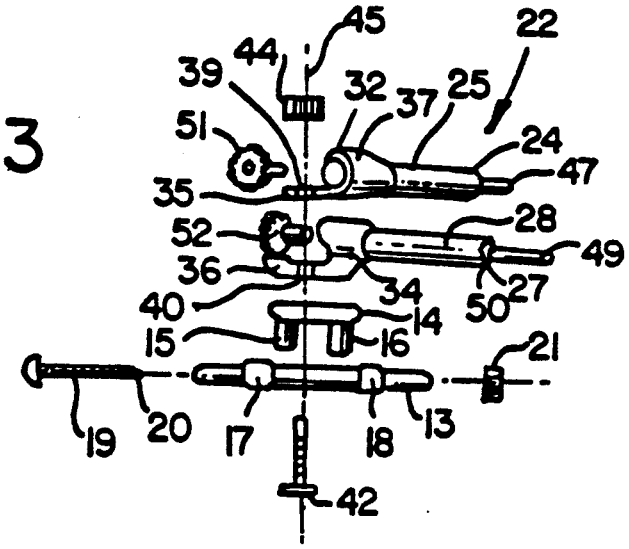
FIG. 4
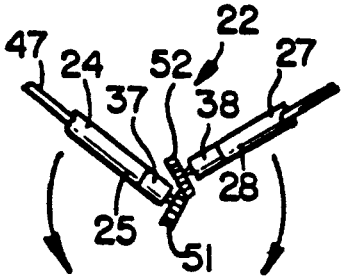
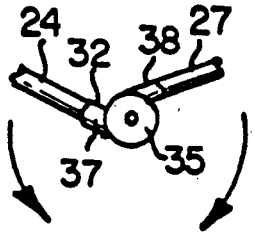
FIG. 5
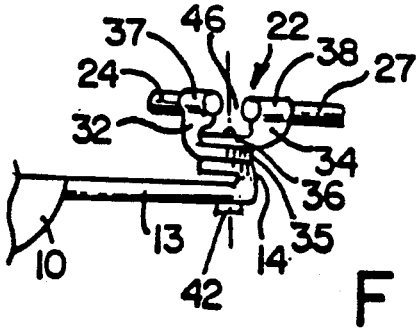
FIG. 6

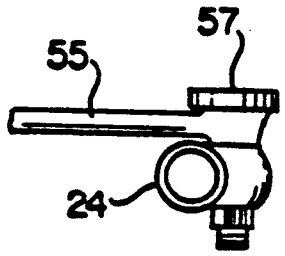
FIG. 12
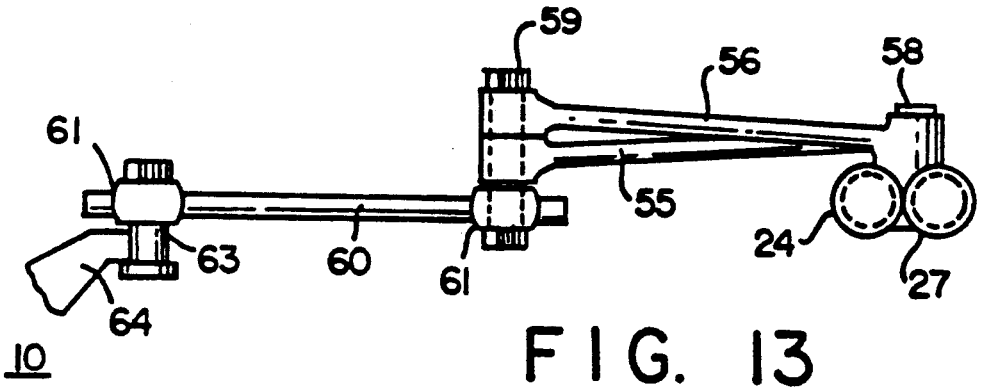
FIG. 13
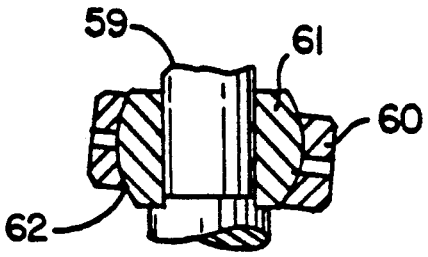
FIG. 14
FIG. 15
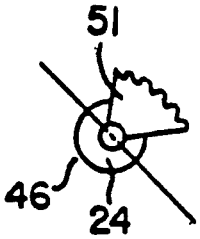
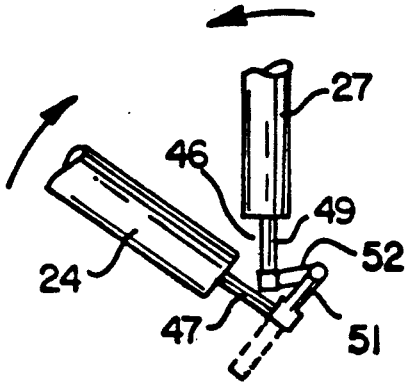
FIG. 16

FIG. 18
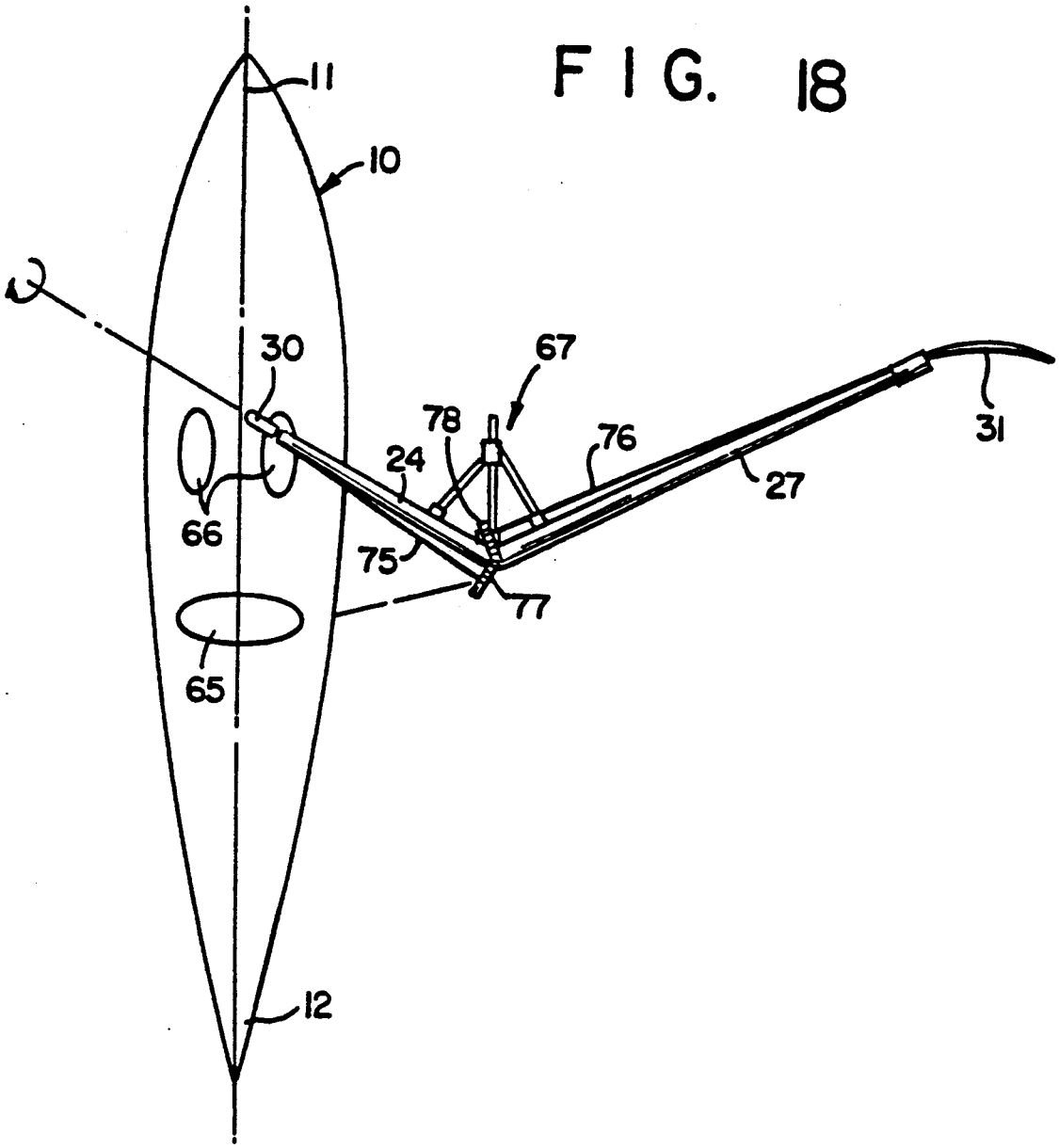
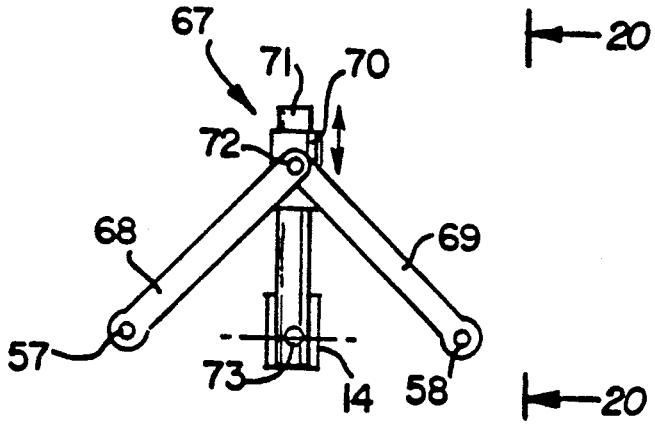
FIG. 19
FIG. 20
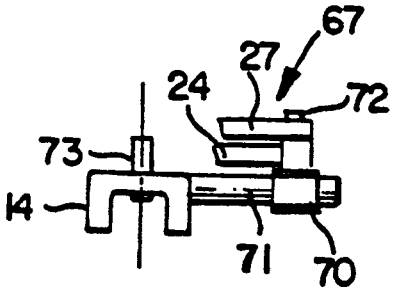

FIG. 24
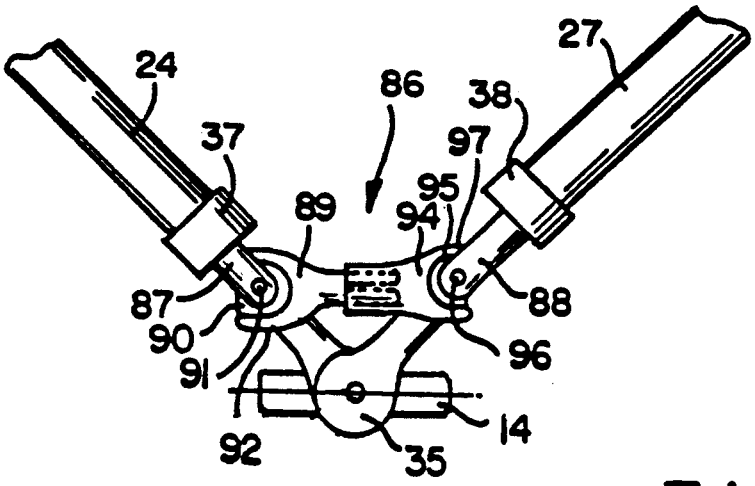
FIG. 25
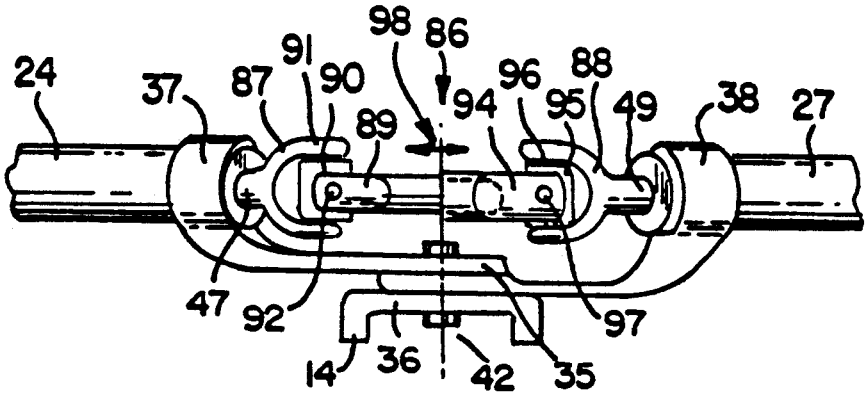
FIG. 34
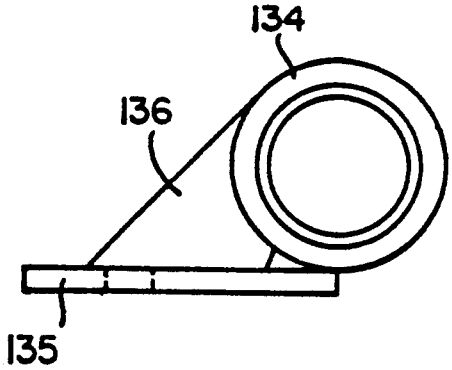
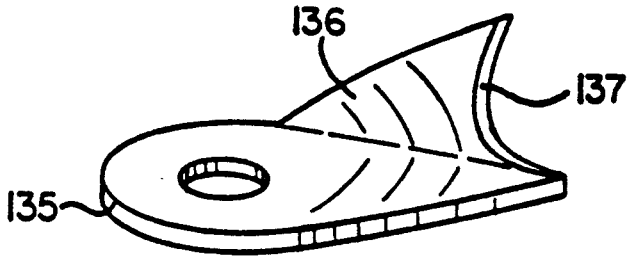
FIG. 35

FIG. 26
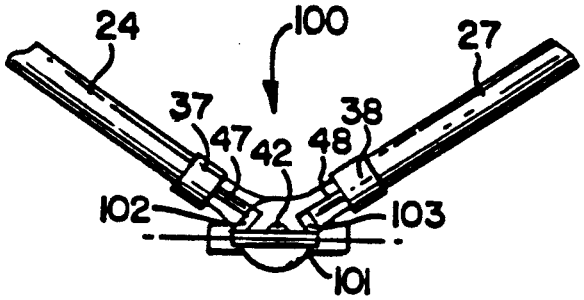
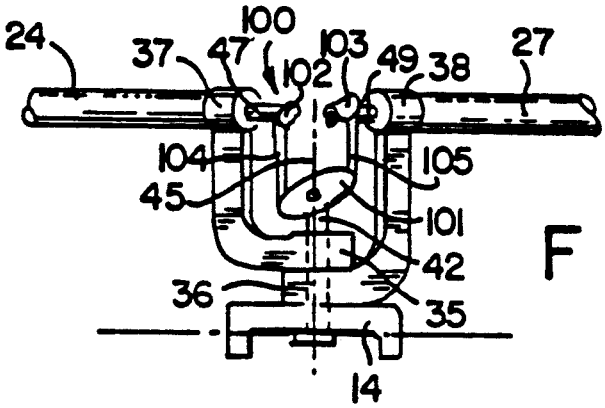
FIG. 27
FIG. 28
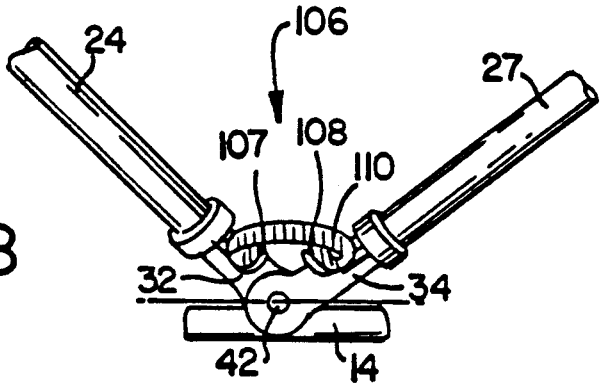
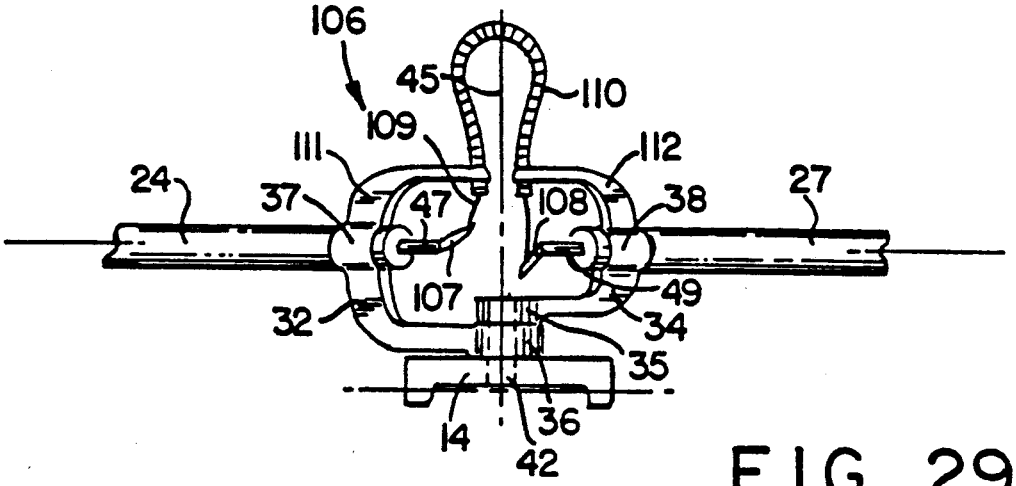
FIG. 29

FORWARDS FACING ROWING APPARATUS WITH FEATHERING OF THE OAR BLADES

BACKGROUND OF THE INVENTION

This invention relates to forwards facing rowing in general. More particularly, the invention relates to a forwards facing rowing apparatus having structurally separate handle and blade looms rotatable about a common sweep hinge axis and including a device for feathering the oar blades during the return stroke of the oarlooms.

Forwards facing rowing apparatus have been known for many years now. Such apparatus have universally employed two oar sections consisting of a handle loom and a structurally separate blade loom. The handle and blade looms have always been hinged at the oarlock mainframe, each by a separate generally vertical sweep hinge, the blade loom being constrained to move backwards when the handle loom moves backwards and forwards when the handle moves forwards, thus allowing forwards facing of the oarsman. This synchronized motion of the two oar looms has been achieved by using a slaving linkage such as crossover link rods, a pair of gear sectors, drums and cables or, in some cases, sprockets and chains, to interconnect the two oar loom sections. The oarlock mainframe is usually mounted to a horizontal teeter hinge that is oriented generally fore and aft to the centerline of the boat hull to permit raising and lowering the paddle or blade to the water. This rather complex articulated system is very poorly adapted to feathering the oar blades by twisting the handles at each end of the handle looms, which has always been a requirement for high performance rowing in racing shells.

The action of feathering consists of rotating the oar blades to flatten them horizontally by turning the hand grips so that on the return stroke of rowing, the plane of the blade will be substantially parallel to the surface of the water. This reduces wind resistance and also forces the blade, in the event it should contact the water, to ride up on the surface and plane, rather than dig in and sink, thereby interrupting the smooth return stroke of the rowing cycle.

When feathering in conventional rearwards facing rowing, the oarsman is taught to lower his wrists to feather, which brings the forwards moving top edge of the oar blade forwards, thereby presenting the blade to the water surface in an upwards slanted direction so as to ride over the surface. However, in forwards facing rowing, the oarsman sits behind, rather than ahead, of the oar handles which is the case in conventional rearwards facing rowing, with the result that should he lower his wrists to feather, the lower edge of the oar blade would proceed it and possibly hit the water. This, of course, would bury the oar beneath the surface of the water, completely disrupting the stroke of the oarsman and, indeed, possibly breaking the oar or, even worse, injuring the oarsman. The oarsman nevertheless has been trained by conventional rowing to drop his wrists to feather the blades, this motion being actually the best way to achieve feathering since the wrists will again be straight for pulling the oarloom during the power stroke. It is therefore highly desirable to rotate the handle grips in a direction opposite to that of the blades in order to achieve feathering in forwards facing rowing.

It is also desirable in forwards facing rowing that the feathering mechanism have as little friction as possible. The oarsman is holding the handles with his bare hands and his hands should not become blistered or over fatigued by feathering. A further reason for low friction is that the oars are usually feathered nearly automatically from the resistance of the water when they are reversed for the return stroke, and a low friction feathering force is important in this function.

SUMMARY OF THE INVENTION

The invention is directed to an improved forwards facing rowing apparatus which obviates many of the problems associated with similar apparatus of the prior art. In this forwards facing rowing apparatus, the usual pair of sweep hinges are replaced by a single common axis, concentric sweep hinge system which is mounted to and rockable with the oarlock mainframe. However, the single axis sweep hinge system of the invention makes it possible to employ a variety of feathering devices or mechanisms which are simple in construction and operation as compared to the rather elaborate and complex systems of the prior art. For example, in a preferred embodiment of the invention, a pair of swing gears are employed in conjunction with a non-rotatable handle and blade loom for feathering the blades, one of the gears being driven from a rotating handle at the opposite end of the handle loom while the mating gear drives or rotates the blade at the opposite end of the blade loom, each gear being affixed to a rotatable member, such as a torque shaft, connected to the handle and blade, respectively. The swing gears are orientated such that the generally vertical tangent line of meshing of the gear pitch circles is aligned with the single common sweep hinge axis. This allows the gears to remain in mesh regardless of the large and rapid changes in angularity that occur between the handle loom centerline and the blade loom centerline during the motion of sweep action in rowing. Swing gears are simple but very advantageous to use in the rowing apparatus since they have very low friction and can accommodate large angle changes between the axes of the gears. In addition, the single set of swing gears reverses the rotation of feathering at the blade from that at the handle which is, of course, very desirable in forwards facing rowing.

Another advantage of the single common sweep hinge system of the invention is the relative ease by which synchronization of the two oarloom sections can be achieved. Thus, as a consequence of having both the handle and blade looms pivoted about a single sweep axis, a number of simple linkage system can be used such as link arms, sprockets, chains, drums and cables or any other known linkage system.

A preferred linkage system, however, consists of a pair of link rods attached to the oarlooms and to one another at a common hinge point. A third link rod lies traversely to the boat hull and is connected to the common hinge point and to the hull or outrigger. The third link rod can be replaced by a fore and aft slide track and slider mounted to the oarlock mainframe. Thus, in either case, when the handle loom is swept forward or aft, the blade loom is constrained to move in the same direction which is required in forwards facing rowing.

According to still another preferred embodiment of the invention, a pair of swing gears are employed in conjunction with a rotatable handle and blade loom for feathering the blades, one of the gears being driven by rotating a handle affixed to the opposite end of the handle loom, in this case, rotating both the handle loom and the gear, while the mating gear drives the blade loom and the blade affixed to its opposite end. Both the handle loom and the blade loom are rotatably supported by non-rotatable members, such as tubular casings, for example, having sweep hinge members attached thereto for rotatably mounting both members about a common sweep axis.

An important feature made possible by this preferred embodiment of the invention is the provision of means for positively locating the handle loom and, consequently, the rotatable blade loom and blade during the rowing operation. The handle loom is located in either one of two positions during the rowing cycle, namely, in a first position corresponding to the power stroke when the blade is orientated in a plane generally normal to the surface of the water and, conversely, in a second position corresponding to the return stroke when the blade is feathered in a plane generally parallel to the surface of the water. This feature is achieved by providing a surface on the rotating handle loom which is adapted to mate with one of two surfaces similarly provided on the non-rotatable, supporting member. Thus, when the handle loom is rotated by the oarsman in the usual fashion during the power and return strokes, the mating surface on the handle loom engages one of the surfaces on the non-rotatable member positioning the blade in either a generally normal or parallel plane with respect to the water. The converse is true when the handle loom is again rotated by the oarsman to position the mating surface so that it engages the other surface on the non-rotatable member.

BRIEF DESCRIPTION OF THE DRAWINGS

The invention will now be described in greater detail with particular reference to the accompanying drawings wherein like reference numerals refer to the same or similar parts and wherein:

FIG. 3 is a view similar to FIG. 2 but showing parts of the rowing apparatus in exploded detail;

FIG. 4 is a plan view of the rowing apparatus illustrated in FIGS. 1–3, showing both the handle and blade looms and a set of swing gears used as a coupling device for feathering the oar blade according to a preferred embodiment of the invention;

FIG. 5 is a plan view of the rowing apparatus taken along the line 5—5 in FIG. 2;

FIG. 6 is a side elevational view of the rowing apparatus of FIG. 1 taken from the stern of the boat hull and with the swing gears removed in order to show in greater detail the handle and blade loom sweep hinge members co-axially mounted onto the oarlock mainframe via a single sweep hinge pin;

FIG. 12 is an elevational view of a hinge assembly for connecting one arm of the linkage mechanism to the handle or blade loom;

FIG. 13 is a side elevational view of the entire linkage mechanism shown in FIGS. 10 and 11;

FIG. 14 is a cross sectional view of a universal type hinge assembly used in the linkage mechanism shown in 15 FIG. 13;

FIG. 15 is an elevational view of a modified swing gear for use in the rowing apparatus of the invention;

FIGS. 16 and 17 are plan views similar to FIG. 4 showing the fore and aft positions of the handle and blade looms in a rowing apparatus employing the modified swing gear shown in FIG. 15;

FIG. 18 is a plan view of a boat and a forwards facing rowing apparatus employing another linkage mechanism according to another embodiment of the invention;

FIG. 19 is an enlarged plan view of the linkage mechanism shown in FIG. 18;

FIG. 20 is a side elevational view of the linkage mechanism shown in FIG. 19;

FIG. 24 is a plan view similar to FIG. 4 showing an oarlock assembly employing double universal and splined slip joints as a coupling device according to still another embodiment of the invention;

FIG. 25 is a side elevational view of the oarlock assembly shown in FIG. 24;

FIG. 26 is a plan view similar to FIG. 4 showing an oarlock assembly employing a walking beam with connecting link rods as a coupling device according to still another embodiment of the invention;

FIG. 27 is a side elevational view of the oarlock assembly shown in FIG. 26;

FIG. 28 is a plan view similar to FIG. 4 showing an oarlock assembly employing levers with a connecting push-pull wire cable as a coupling device according to yet another embodiment of the invention;

FIG. 29 is a side elevational view of the oarlock assembly shown in FIG. 28;

FIG. 34 is a cross-sectional view of part of a non-rotatable, tubular casing for supporting the rotatable handle loom showing the sweep hinge member for mounting the assembly along the common sweep axis; and FIG. 35 is a perspective view of a combined sweep hinge member and bracket for mounting the handle loom assemble shown in FIG. 31.

DESCRIPTION OF THE PREFERRED EMBODIMENTS

Figure 1:
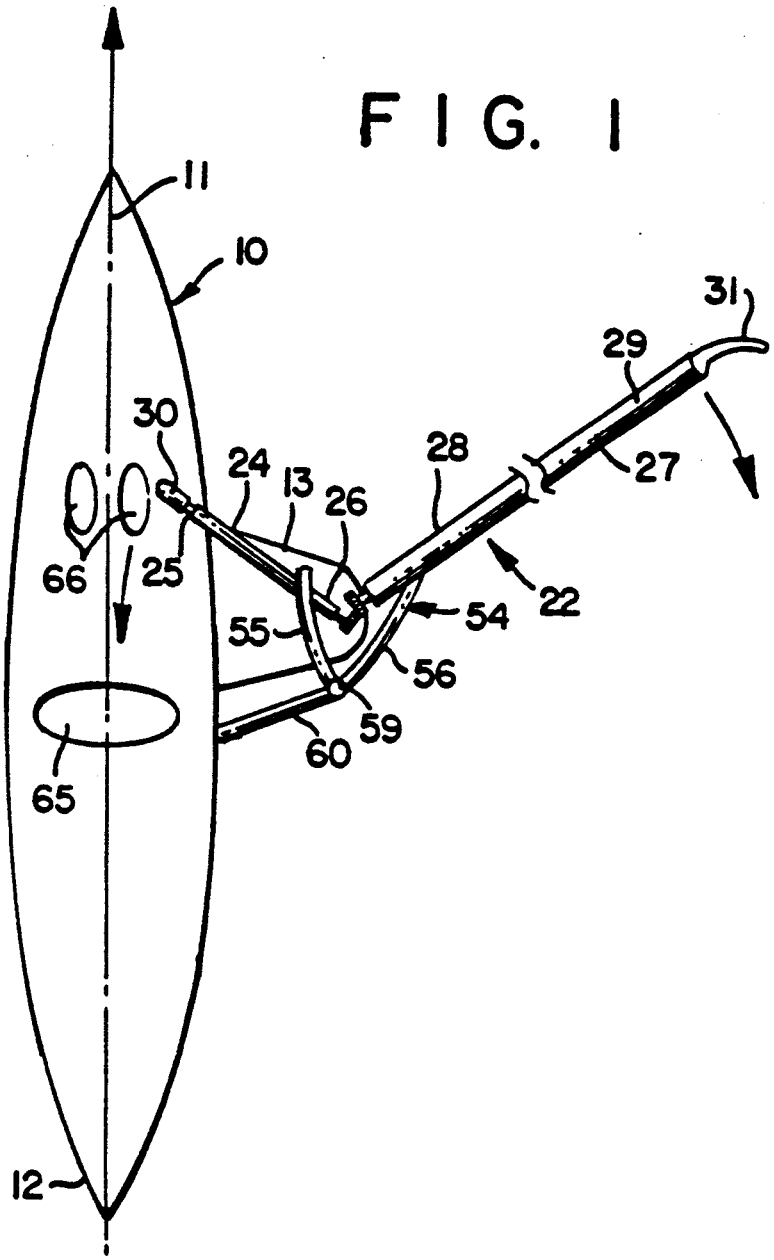
FIG. 1 is a plan view of a boat equipped with a forwards facing rowing apparatus according to the invention.

The general arrangement of a boat or shell equipped, with a forwards facing rowing apparatus according to a preferred embodiment of the invention is shown in FIGS. 1-14 wherein the numeral 10 is a boat hull having fore and aft ends 11, 12, respectively, and 13 is one of a pair of outriggers extending laterally outward from each side of the hull. Although only one of the outriggers is shown in the drawing along with its associated rowing apparatus for purposes of simplicity, it will be understood that both outriggers and the rowing apparatus are identical in construction and design.

Figure 2:
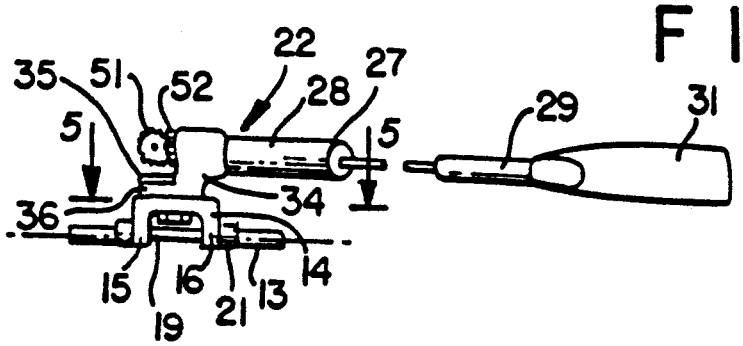
FIG. 2 is a side elevational view of the forwards facing rowing apparatus shown in FIG. 1.
Figure 8:
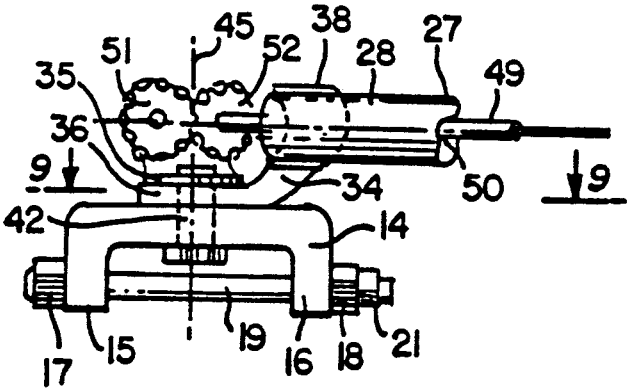
FIG. 8 is an enlarged side elevational view of the oarlock assembly looking inward from the right side in FIG. 7.
Figure 9:
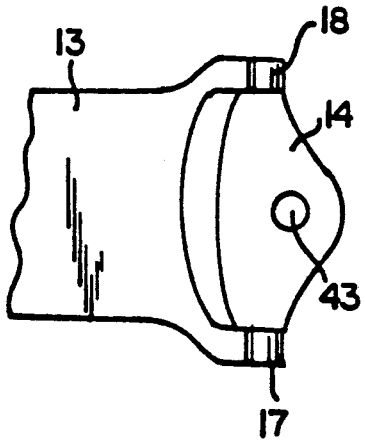
FIG. 9 is an enlarged plan view of the outrigger, oarlock mainframe and teeter hinge members for mounting the oarlock assembly shown in FIGS. 7 and 8.

An oarlock mainframe 14 having a pair of teeter hinge members 15, 16 is mounted to the outer end of the outrigger 13. As best shown in FIGS. 2, 3 and 8, the outrigger 13 has a pair of outwardly extending, spaced apart teeter hinge members 17, 18 which mate with the teeter hinge members 15, 16 on the oarlock mainframe 14. A teeter hinge pin 19 having a threaded outer end 20 passes through the mating teeter hinge members 15, 17 and 16, 18, respectively, and is locked in place by a fastener 21. The oarlock mainframe 14 is rotatable about the axis of the teeter hinge pin 19 which extends in a generally horizontal direction fore and aft of the boat hull 10.

An articulated oar loom assembly indicated generally at 22 is mounted onto the rotatable oarlock mainframe 14. As best shown in FIG. 1, the oar loom assembly includes an elongated handle loom 24 having an in-board end 25 and an outboard end 26 and an elongated blade loom 27 having an inner end 28 and an outer end 29. A handle or grip 30 is rotatably mounted to the in-board end 25 of the handle loom 24 and a blade 31 is rotatable mounted to the outer end 29 of the blade loom 27.

The handle loom 24 has affixed to its out-board end 26 a sweep hinge member 32 (FIG. 6). Similarly, the blade loom 27 has affixed to its inner end 28 a sweep hinge member 34. The preferred sweep hinge members 32, 34 are generally L-shaped in configuration, each having a circular base portion 35, 36 (FIG. 5) at its lower end and an outwardly extending tubular sleeve 37, 38 at its upper end. The base portions 35, 36 have central apertures 39, 40 (FIG. 3) and flat sides which serve as bearing surfaces. The tubular sleeves 37, 38 are disposed generally tangential to the circular base portions 35, 36 and are of such size to fit snugly around the ends of the handle and blade looms 24, 27.

As best shown in FIGS. 3 and 6, the handle and blade looms 24, 27 are rotatably mounted to the oarlock mainframe 14 via the two sweep hinge members 32, 34 and a single sweep hinge pin 42. The hinge pin 42 extends through an aperture 43 in the oarlock mainframe 14 (FIG. 9), passes co-axially through the apertures 39, 40 in the sweep hinge members 32, 34 and is secured at its outer end by a fastener 44 (FIG. 3). It will be seen by this arrangement that both the handle loom 24 and the blade loom 27 are rockable about the generally horizontal axis of the teeter hinge pin 19 and are also rotatable about a common generally vertical axis 45 extending through the sweep hinge pin 42. It will also be seen that by mounting the ends of the handle and blade looms 24, 27 in substantially tangential arrangement with respect to the sweep hinge members 32, 34, space is provided directly above the hinge pin 42 to accommodate a coupling means for feathering the blade 31 during the return stroke of the rowing cycle as shall be described hereinafter in greater detail.

In the embodiment of the invention illustrated in FIGS. 1-14, an elongated torque shaft 47 is mounted within a longitudinal bore 48 (FIG. 7) extending axially from the outboard end 26 to the in-board end 25 of the handle loom 24 where one end of the shaft 47 is affixed to the handle 30. Similarly, an elongated torque shaft 49 (FIG. 8) is mounted within a longitudinal bore 50 extending axially from the inner end 28 to the outer end 29 (FIG. 7) of the blade loom 27 where one end of the shaft 49 is affixed to the blade 31. At its opposite end, the torque shaft 47 extends a short distance beyond the handle loom 24 into the space 46 provided above the sweep hinge pin 42 (FIG. 8), while the other torque shaft 49 extends a short distance beyond the blade loom 27 also into the space 46, both ends of the shafts being orientated in a generally tangential relation to the pair of co-axial mounted sweep hinge members 32, 34.

Figure 7:
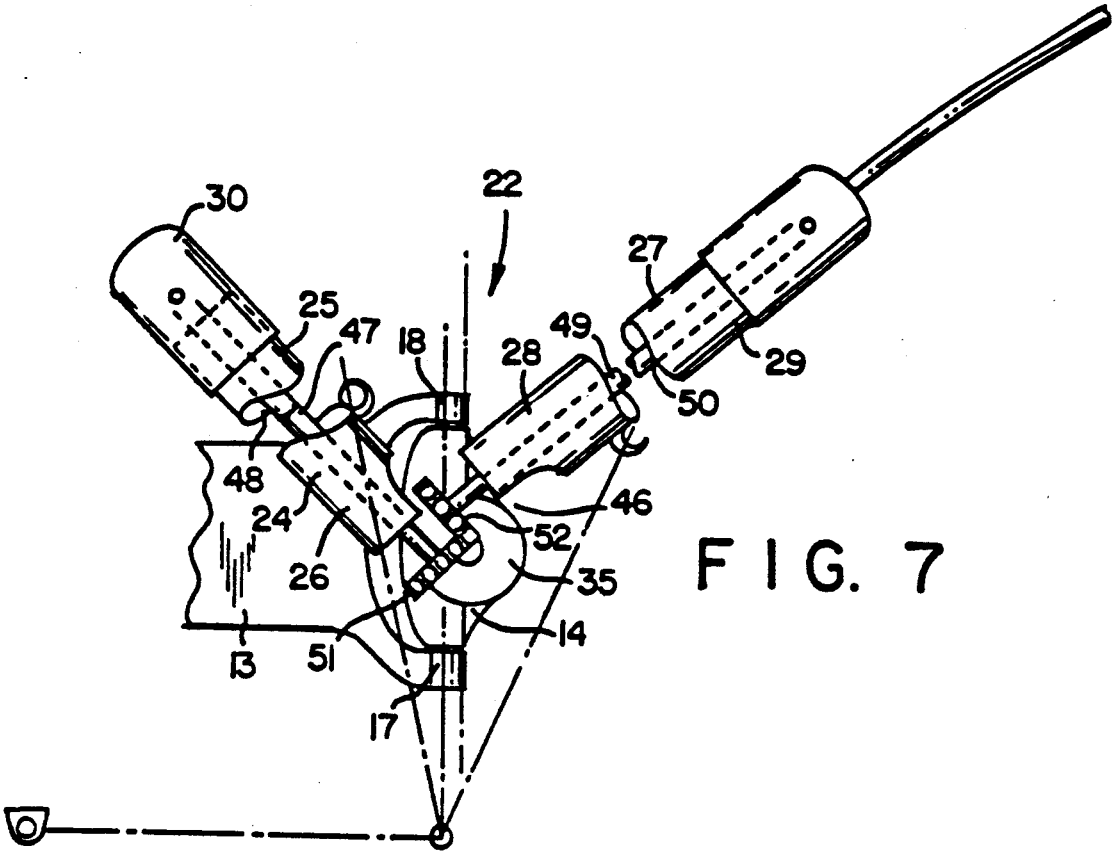
FIG. 7 is an enlarged plan view of the entire oarlock assembly shown in FIG. 1.

A swing gear 51 is affixed to the end of the torque shaft 47 in the space 46 and is rotatable together with the handle 30. Similarly, a swing gear 52 is affixed to the end of the torque shaft 49 in the space 46 and is rotatable together with the blade 31. The swing gears 51, 52 are arranged to engage one another at variable sweep angles with the tangent line of the gear pitch circle of each swing gear aligned with the common sweep hinge axis 45 extending through the sweep hinge pin 42 as best shown in FIGS. 7 and 8. This arrangement of the swing gears 51, 52 is very important since it allows the gears to remain in mesh regardless of the large and rapid changes in angularity that occur between the handle and blade looms 24, 27 during the sweep action of rowing.

During the return stroke of the blade loom 27, the blade 31 can be easily feathered to a position substantially parallel to the surface of the water by simply rotating the handle 30. Conversely, by rotating the handle 30 in the opposite direction, the blade 31 can be changed to a position substantially normal to the surface of the water during the power stroke. The motion of the handle 30 is transferred directly to the blade 31 through the two torque shafts 47, 49 via the coupling arrangement employing the two swing gears 51, 52. The use of the swing gears 51, 52 has many advantages in this embodiment of the rowing apparatus. A major advantage is that the swing gears reverse the rotation of feathering at the blade 31 from that at the handle 30. Thus, the oarsman is able to employ the conventional method of feathering used in rearwards facing rowing, that is, by lowering his wrist during the return stroke. As pointed out above, this is highly desirable in the case of forward facing rowing. Moreover, swing gears have a very low friction and reduce oarsman's fatigue brought on by feathering. Of course, as pointed out above, swing gears can easily accommodate large angle changes between the axes of the gears.

Figure 11:
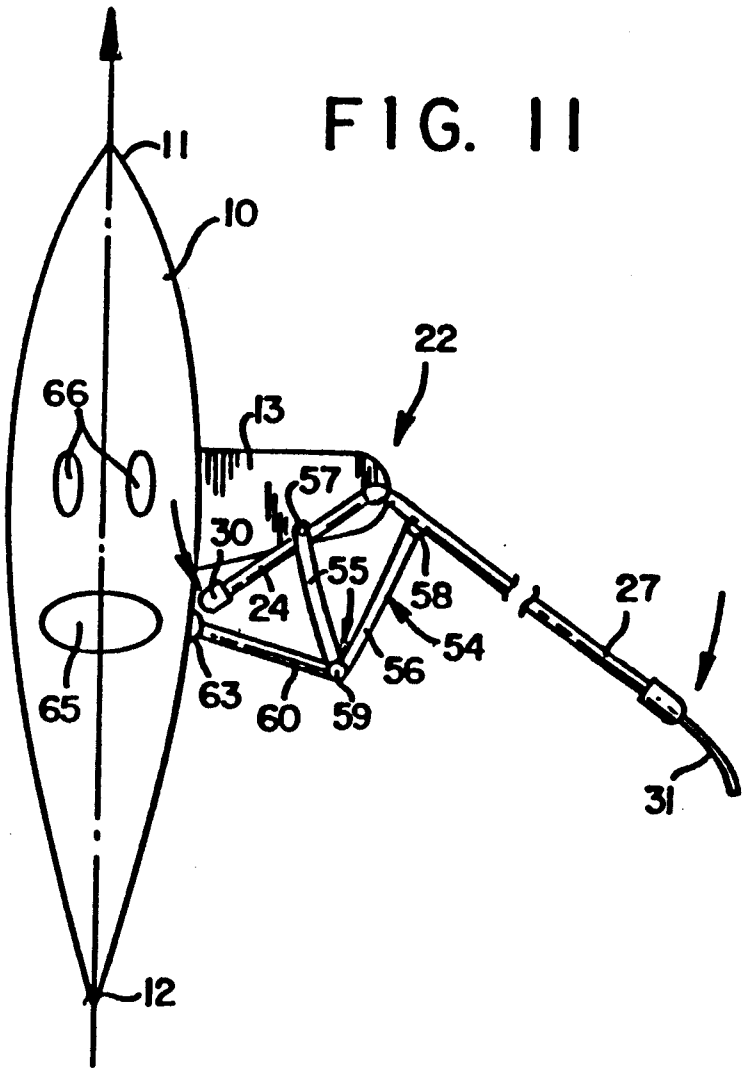
FIGS. 10 and 11 are plan views similar to FIG. 1 showing the forward and aft positions of a linkage mechanism used to synchronize movement of the handle and blade looms during the rowing operation.
Figure 10:
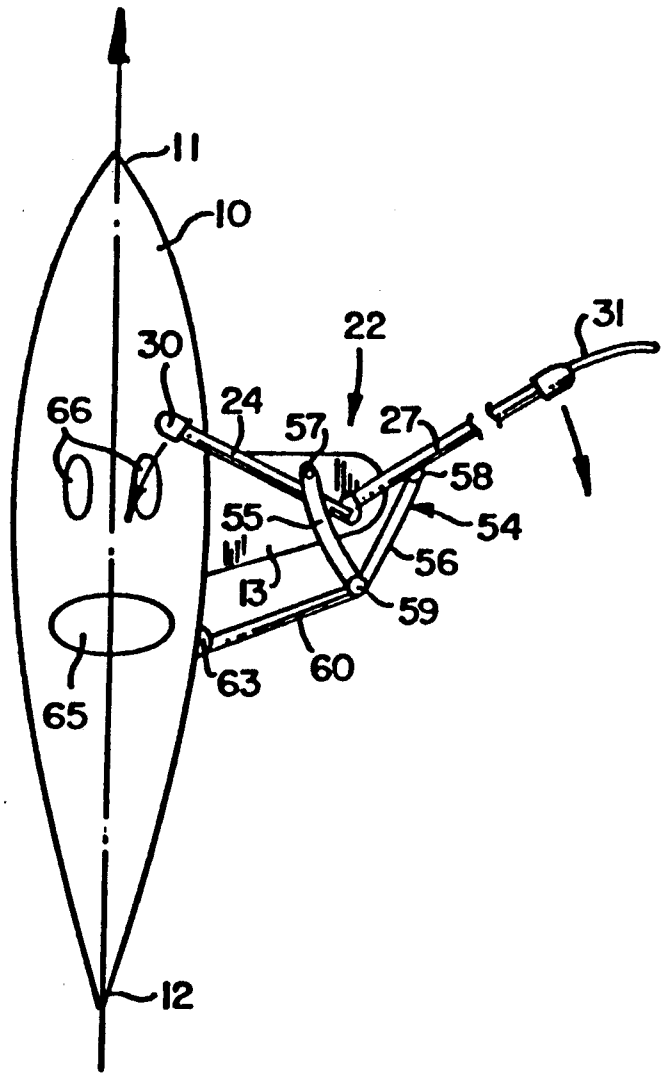

Referring specifically to FIGS. 1, 10 and 11, a linkage assembly indicated generally at 54 is provided for synchronizing the motion of the handle loom 24 and the blade loom 27. The linkage includes a first link rod 55 connected near one end to the handle loom 24 and a second link rod 56 connected near one end to the blade loom 27. The first link rod 55 is connected to the side of the handle loom 24 facing the fore end of the boat hull 10 by a vertical hinge pin 57 (FIG. 12), the rod 55 being shown overlying the handle loom 24 but it can of course underlie the handle loom as well. The second link rod 56 is connected to the aft side of the blade loom 27 by a similar bi-directional vertical hinge pin 58. In the embodiment of the linkage assembly illustrated, the two link rods 55, 56 are connected to the handle and blade looms 24, 27 at about an equal distance along their lengths from the common sweep hinge pin 42 and are connected to one another at their opposite ends by a common, floating, vertical hinge pin 59. A third link rod 60 is connected at one end to both the first and second link rods 55, 56 using the same common hinge pin 59, the opposite end of the third link rod 60 being connected at a fixed point on either the boat hull 10 or the outrigger 13. The hinge pin assemblies for connecting the two ends of the third link rod 60 are different from those employed to connect the link rods to the handle and blade looms 24, 27, that is, the hinge pin assemblies are of the universal type as more clearly shown in FIGS. 13 and 14. For example, the common hinge pin 59 used for connecting one end of the third link rod 60 to the opposite ends of the first and second link rods 55, 56 extends through a spherical bearing 61 which is rotatably mounted inside a spherical aperture 62 located at the end of the link rod 60. The hinge pin assembly at the opposite end of the link rod 60 is identical except that a hinge pin 63 is used to connect the link rod to a bracket 64 mounted, for example, to the boat hull 10.

It will be seen by reference particularly to FIGS. 10 and 11 that the linkage assembly 54 serves to synchronize the motion of the handle and blade looms 24, 27 during the rowing operation. The oarsman sits on the seat 65 with his feet secured to the footrest 66 and facing forward toward the fore end 11 of the boat hull 10. When the oarsman pulls the handle loom 24 (FIG. 10) rearwardly toward the aft end 12, the blade loom 27 is forced to move in the same direction as that of the handle loom 24, that is, rearwardly toward the aft end 12 as shown in FIG. 11. Conversely, during the return stroke, the oarsman pushes the handle loom 24 in the opposite direction and the blade loom 27 is forced to move in the same direction as that of the handle loom 24, that is, toward the fore end 11 of the boat hull 10. At the same time, it will be seen that the universal hinge pin assemblies including the two spherical bearings 61 rotatably mounted at opposite ends of the third link rod 60 allow the oarlooms to teeter or rock about the horizontal axis of the teeter hinge pin 19. Thus, during the power stroke as seen in FIGS. 10 and 11, the oarsman raises the handle loom 24 to lower the blade 31 into the water at the beginning of the stroke, while during the return stroke, the oarsman lowers the handle loom 24 in order to raise the blade 31 out of the water until the rowing cycle has been completed.

Figure 17:
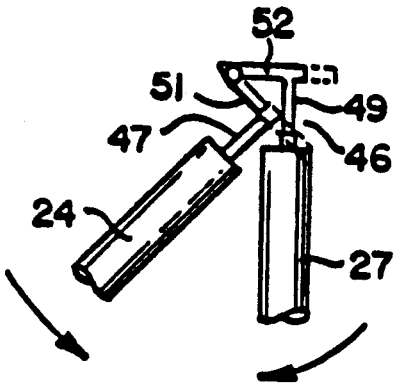

In FIGS. 16 and 17, there is shown a modification of the rowing apparatus just described wherein each swing gear 51, 52 is approximately a quarter sector (FIG. 15) of a full gear circle, leaving additional room to accommodate the ends of the torque shafts 47, 49 within the space 46. Since only a quarter sector of the gear is required to feather the blade 31 through an angle of 90 degrees, the remaining portion of the gear circle can be eliminated without affecting operation of the swing gears, thereby increasing the sweep angle of both the handle and blade looms 24, 27.

FIGS. 18–20 show a different embodiment of the rowing apparatus wherein the linkage assembly 54 of FIG. 1 used to synchronize the motion of the handle and blade looms 24, 27 is replaced by a track and slider arrangement indicated generally at 67. As shown, this track and slider arrangement includes a first link rod 68 hingeably connected at one end to the handle loom 24, a second link rod 69 hingeably connected at one end to the blade loom 27, the opposite ends of the first and second link rods 68, 69 being hingeably connected together and to a slider 70 via a hinge pin 72. The slider 70 is movably mounted onto an elongated track 71 which is fixedly secured at one end to the oarlock mainframe 14 as shown in FIGS. 19 and 20 and which is orientated generally fore and aft of the boat hull 10. The two link rods 68, 69 are generally of equal length and are attached to the handle and blade looms 24, 27 using the same bi-directional hinges described hereinabove at points substantially equi-distant from the sweep hinge pin 42. It will be seen that this track and slider arrangement operates in basically the same manner as the linkage assembly 54 of FIG. 1, the link rods 68, 69 forcing the handle and blade looms 24, 27 to move together in the same direction during the sweep action of rowing.

Also in the embodiment of the rowing apparatus shown in FIG. 18, the co-axially mounted torque shafts 47, 49 are replaced by external torque shafts 75, 76 rotatably mounted alongside the handle and the blade looms 24, 27. The torque shaft 75 is located on the aft side of the handle loom 24 while the torque shaft 76 is located on the fore side of the blade loom 27. This construction also allows the use of swing gears 77, 78 mounted to the ends of the torque shafts 75, 76, the swing gears being similarly arranged to engage one another such that the tangent line of the pitch gear circle of each gear is aligned with the sweep hinge axis 73. It will be understood, of course, that the shafts 75, 76 may also be mounted onto opposite sides of the handle and blade looms 24, 27 as will readily occur to those skilled in the art.

An important feature of the linkage assemblies 54, 67 illustrated in FIG. 1 and FIGS. 18–20, respectively, is the ability to set the linkages to different linkage ratios between the handle loom and the blade loom to speed up (or slow down) the blade sweep motion. In conventional rowing during the power or propulsion stroke, the oarsman is accelerating the mass of his body forwards in the boat while the propulsion of the blades accelerates the boat hull forwards at the same time. However, in forwards facing rowing, the oarsman's body is accelerating aft while the boat hull is accelerating forwards. This produces less "feel" of pulling on the propulsion stroke and a more negative pulling at the feet in the laced shoes. The result feels like a two-speed bike in too low a gear. To avoid this, the linkage ratio between the handle loom and the blade loom can be adjusted to produce a faster sweep of the blade loom than the handle loom. Thus, instead of having the two link rods 68, 69 in FIG. 18, for example, of generally equal length and attached to the handle and blade looms 24, 27 at points substantially equi-distant from the sweep hinge pin 42, the link rods can be attached at unequal distances from the sweep hinge pin 42 to attain either a faster or slower sweep motion of the blade loom.

Figure 22:
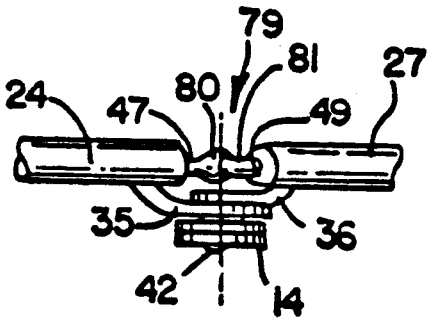
FIG. 22 is a side elevational view of the oarlock assembly shown in FIG. 21.
Figure 21:
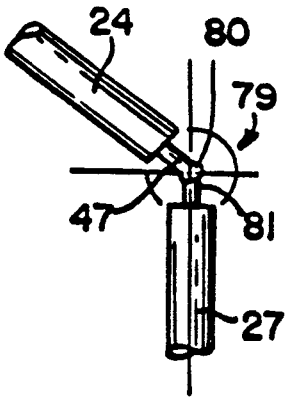
FIG. 21 is a plan view similar to FIG. 4 showing an oarlock assembly employing a single universal joint as a coupling device for feathering the oar blade according to another embodiment of the invention.
Figure 23:
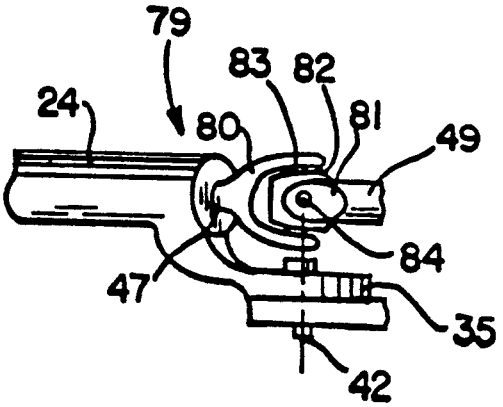
FIG. 23 is an enlarged side elevational view of part of the oarlock assembly shown in FIG. 22.

FIGS. 21–23 show another embodiment of the invention wherein the swing gears 51, 52 are replaced by a single universal coupling indicated generally at 79. As shown, the universal coupling includes a yoke 80 affixed to the end of one of the torque shafts, in this case the shaft 47 mounted co-axially within the handle loom 24. A yoke 81 is affixed to the end of the other torque shaft 49 and is connected to the yoke 80 via a hinge block 82 and a pair of hinge pins 83, 84. The hinge pins 83, 84 extend through the block 82 at substantially right angles to one another as best shown in FIG. 23. The two yokes 80, 81 and the hinge block 82 are centered generally about the common sweep hinge axis 42 (see FIG. 22). This arrangement, however, does not reverse the rotation of feathering at the blade from that at the handle as in the case of the swing gears.

A somewhat similar embodiment of the invention is shown in FIGS. 24 and 25. Here, the coupling arrangement indicated generally at 86 includes a pair of Carden type universal joints, a first joint including a yoke 87 attached to the end of the torque shaft 47 and a yoke 88 attached to the end of the torque shaft 49. The first joint includes a mating yoke 89 affixed to the yoke 87 via a hinge block 90 and two hinge pins 91, 92. The second joint includes a mating yoke 94 affixed to the yoke 88 via a hinge block 95 and two hinge pins 96, 97. As in the previous embodiment, the hinge pins extend through the hinge block at substantial right angles to one another. The two mating yokes 89, 94 form a splined slip joint 98 at their opposite ends, one of the yokes 94 having a hollow end and the other yoke 89 being of a lesser diameter so as to slideably fit inside the hollow end of the yoke 94. This arrangement has the advantage over the previous arrangement in that the two universal joints are able to accommodate a much larger angular displacement of the handle and blade looms 24, 27. Moreover, the splined slip joint is able to transmit motion from the torque shaft 47 to the torque shaft 49 and to accommodate changes in the universal joint spacing due to the angular sweep arc of each oar loom. However, rotation of the blade 31 is in the same direction as that of the handle 30 with this arrangement.

FIGS. 26 and 27 show still another embodiment of the of the invention wherein the pair of swing gears 51, 52 are replaced by a coupling mechanism including a walking beam and linkage arrangement indicated generally at 100. A rocker arm 101 is pivotally mounted at its center to the upper end of a somewhat longer sweep hinge pin 42. A first lever 102 is affixed at one end to the torque shaft 47 in the handle loom 24 and a second lever 103 is affixed at one end to the torque shaft 49 in the blade loom 27. A first link rod 104 is then connected between the outer end of the first lever 102 and one end of the rocker arm 101. A second link rod 105 is connected between the outer end of the second lever 103 and the opposite end of the rocker arm 101. It will be seen that any motion of the torque shaft 47 caused by turning the handle 30 is transferred directly to the rocker arm 101 via the first lever 102 and link rod 104, causing the rocker arm to rotate in either the clockwise or counterclockwise direction. This motion in turn is transferred to the shaft 47 via the second lever 103 and link rod 105, rotation of the shaft 49 and the blade loom 27 being in the same direction as the shaft 47 and the handle loom 24. It should also be noted in this arrangement that the rocker arm 101 is rotatable along with the hinge pin 42 about the common sweep axis 45 and thus permits both oarlooms to move through large sweep angles without interfering with the feathering action.

In FIGS. 28 and 29, there is shown still another embodiment of the invention wherein the pair of swing gears 51, 52 are replaced by a similar push-pull linkage assembly indicated generally 106. This linkage assembly includes a first lever 107 connected to the torque shaft 47 in the handle loom 24 and a second lever 108 connected to the torque shaft 49 in the blade loom 27. A push-pull flexible wire 109 enclosed inside a flexible casing 110 is provided and has one end connected to the outer end of the first lever 107 and its opposite end connected to the outer end of the second lever 108. The two sweep hinge members 32, 34 are modified to include in this embodiment a pair of generally L-shaped arms 111, 112 which extend upwardly beyond the tubular sleeves 37, 38, respectively. The arms 111, 112 are disposed radially inward toward the common sweep hinge axis 45 and secure the opposite ends of the flexible casing 110 against axial movement along the wire 109. It will be seen that any motion of the torque shaft 47 caused by turning the handle 30 is transferred directly to the push-pull wire 109 via the first lever 107 causing the second lever 108 and in turn the shaft 49 and blade 31 to move in the same direction as the shaft 47.

In all of the embodiments of the rowing apparatus described hereinabove, the handle and blade loom are non-rotatable members and a rotatable member, such as a torque shaft, extends along each one of the oarloom members, the handle being affixed to one torque shaft and the blade being affixed to the other torque shaft. FIGS. 30-35, inclusive, show different embodiments of the rowing apparatus according to the invention wherein at least one of the handle or blade loom is a rotatable member and wherein a non-rotatable member is provided for supporting the rotatable handle and/or blade loom, the handle in this case being affixed to and rotatable with the handle loom and the blade being affixed to and rotatable with the blade loom.

Figure 30:
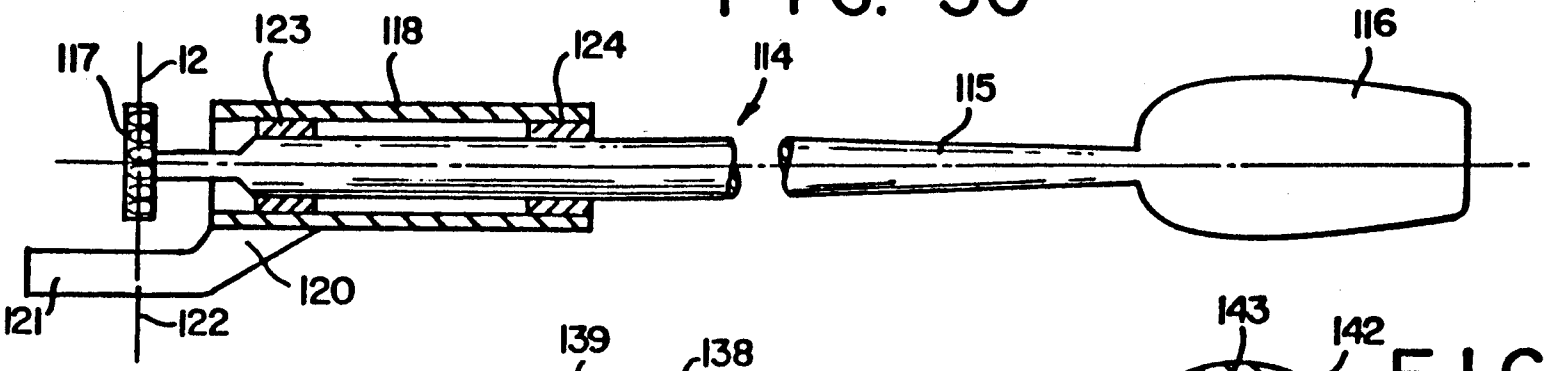
FIG. 30 is a side elevational view of a rotatable blade loom assembly employed in a rowing apparatus according to another embodiment of the invention.

FIG. 30, for example, shows a blade loom assembly, generally indicated at 114, which includes an elongated, rotatable blade loom 115 having a blade 116 affixed to its outer end and a swing gear 117 affixed to its inner end. The blade loom 115 is rotatably supported inside a non-rotatable, tubular casing 118 which serves as a bearing housing. Preferably, the tubular casing 118 extends along the blade loom 115 from its inner end to about one-third or less of its length. The casing 118 is affixed at one end via a bracket 120 to one of the sweep hinge members 121 which is mounted about the common sweep hinge axis 122. An annular bearing 123, such as a roller bearing, is mounted inside one end of the tubular casing 118. Similarly, an annular bearing 124 is mounted inside the opposite end of the casing 118. The bearings 123, 124 allow for free rotation of the elongated handle loom 115 within the tubular casing 118.

An important feature of the rotatable blade loom assembly described hereinabove is that all of the moveable parts, such as the roller bearings, which would normally be made of corrodible metals, are not directly exposed to the water during the rowing operation and, therefore, are not required to be sealed.

Figure 32:
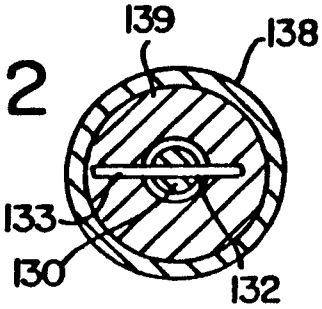
FIG. 32 is a cross-sectional view of the handle loom assembly taken along the line 32—32 in FIG. 31.
Figure 31:
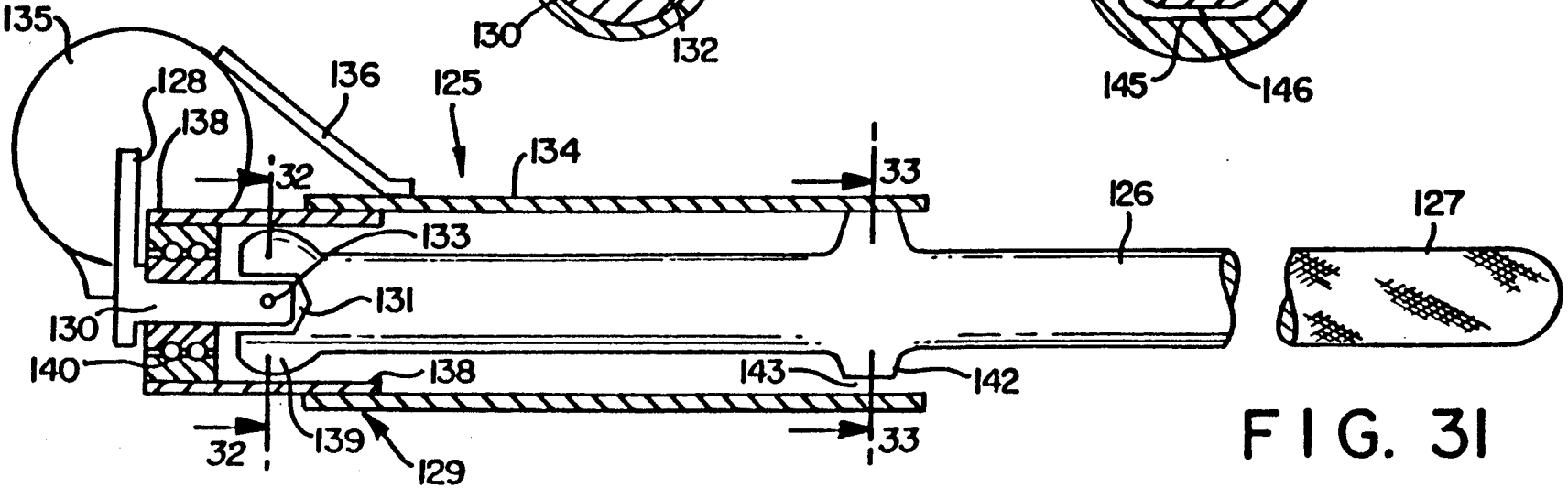
FIG. 31 is a similar view of a rotatable handle loom assembly employed in a rowing apparatus according to an embodiment of the invention similar to that shown in FIG. 30.

FIG. 31 shows a handle loom assembly, generally indicated at 125, which includes an elongated rotatable handle loom 126 having a handle 127 affixed to its inner end and a swing gear 128 (shown here as a swing gear sector similar to that shown in FIG. 15) affixed to its outer end. The swing gear 128 is connected to a short extension shaft 130 which is connected in turn to the handle loom 126 via a universal joint generally indicated at 129. The shaft 130 extends co-axially into a blind hole or bore 131 which is drilled into the outer end of the handle loom 126. The short shaft 130 is joined to the handle loom 126 via a universal pin and slot arrangement as shown in FIG. 32. The drive pin 132 passes through the shaft 130 and is disposed inside a driven slot 133 provided in the mating member, that is, the drilled end of the handle loom 126. The drive pin 132 can also be placed in the end of the handle loom while the slot is provided in the short shaft 130.

The handle loom 126 is rotatably mounted inside a nonrotatable, tubular casing 134 which also serves as a bearing housing. Preferably, the tubular casing 134 extends along the handle loom 126 from its outer end to about one-third or less of its length. The casing 134 is affixed at one end to one of the sweep hinge members 135 via a bracket 136 as shown more particularly in FIGS. 31 and 34. The bracket 136 is shaped with an arcuate section 137 for receiving the cylindrical wall portion of the tubular casing 134 as shown in FIG. 35. The casing 134 is welded or otherwise secured to the bracket 136 which is in turn welded or otherwise secured to the sweep hinge member 135.

An inner tubular sleeve 138 is mounted inside the tubular casing 134 at its end adjacent to the outer end of the handle loom 126. The handle loom 126 is shaped with an enlarged outer end as shown at 139 which fits rotationally within the inner sleeve 138. An annular bearing 140, such as a double ball bearing, is mounted inside the outer end of the tubular sleeve 138 and allows for alignment and free rotation of the shaft 130 affixed to the swing gear 128.

The handle loom 126 is formed with an annular embossment 142 which is located just short of the point where the handle loom 126 extends beyond the opposite end of the tubular casing 134 as best shown in FIG. 31. The annular embossment 142 has an outer diameter which is less than the inner diameter of the tubular casing 134 providing a clearance 143 therebetween which enables the handle loom 126 to move laterally within the casing.

Figure 33:
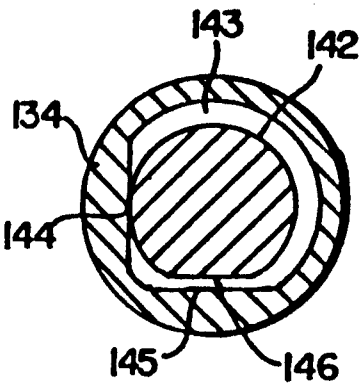
FIG. 33 is a similar view of the handle loom assembly taken along the line 33—33 in FIG. 31.

As best shown in FIG. 33, the tubular casing 134 is provided with two flat surfaces 144, 145 on its interior wall within the same opposite end of the casing. The two flat surfaces are arranged perpendicular to one another, one of the flat surfaces 144 being disposed vertically while the other flat surface 145 is disposed horizontally with respect to the surface of the water. The annular embossment 142 on the handle loom 126 is similarly provided with a single flat surface 146 which is adapted to engage either one of the flat surfaces 144 or 145 on the casing 134 depending on the angular position of the rotatable handle loom 126. It will be seen then that during the power stroke, the oarsman can easily position the blade at an angle that is normal to the surface of the water by simply placing the flat surface 146 on the embossment 142 against the vertically arranged flat surface 144 on the casing 134 and, conversely, the oarsman can feather the blade at a generally horizontal angle with respect to the surface of the water by simply rotating the handle loom 126 to place the flat surface 146 against the horizontally arranged flat surface 145. The oarsman can actually "feel" the flat surface 146 engaging either of the flat surfaces 144, 145 as he drops and raises his wrist to rotate the handle 127 during both the power and feathering strokes. This is a considerable advantage to the oarsman during competitive rowing since he is not required to actually look at both blades to determine their attitude which might otherwise distract him from his rowing efforts.

It should be noted that the rotatable blade and handle loom assemblies 114, 125 shown in FIGS. 30 and 31–35, respectively, can be employed together with one another to constitute a single oarloom assembly or, alternatively, either one of the rotatable blade or handle looms may be employed with any one of the non-rotatable handle or blade looms illustrated in the previous embodiments. The same is also true in the case of the various coupling devices disclosed herein which can be employed to replace either of the swing gears 117 or 128 shown in FIGS. 30 or 31, respectively.

What is claimed is:

1. A forwards facing rowing apparatus comprising, in combination: a boat having an elongated hull with fore and aft ends, an outrigger projecting laterally outward from one side of said hull and an oarloom assembly mounted to said outrigger, said oarloom assembly comprising a handle loom having an inboard end and an outboard end, a handle rotatable about the handle loom located at said inboard end of said handle loom, a blade loom extending outwardly from said outrigger and having an inner end and an outer end, a blade located at said outer end of said blade loom, an oarlock mainframe hingeably mounted to said outrigger for rotation about an axis orientated generally fore and aft of said hull, a first sweep hinge member affixed to the outboard end of said handle loom, a second sweep hinge member affixed to the inner end of said blade loom, means for mounting said first and second sweep hinge members on said oarlock mainframe for rotation about a common sweep axis orientated in a generally perpendicular relationship with respect to said axis of rotation of said mainframe, linkage means connected to said handle loom and said blade loom for synchronizing the motion of said blade loom with that of said handle loom whereby said blade loom is constrained to move in the same direction as that of said handle loom when said handle loom is rotated about said common sweep axis and blade feathering means associated with both said handle loom and said blade loom for changing the angle of incidence of said blade with respect to the surface of the water floating said hull when said handle is rotated.

2. A rowing apparatus according to claim 1, wherein both said handle loom and said blade loom are non-rotatable members and wherein said blade feathering means includes a first rotatable member connected to said handle and extending along said non-rotatable handle loom, a second rotatable member connected to said blade and extending along said non-rotatable blade loom and a coupling device connecting said rotatable members for transmitting torque and rotary motion therebetween.

3. A rowing apparatus according to claim 2, wherein said first and second rotatable members are elongated torque shafts mounted coaxially within said handle loom and said blade loom.

4. A rowing apparatus according to claim 2, wherein said first and second rotatable members are elongated torque shafts mounted externally along side said handle loom and said blade loom.

5. A rowing apparatus according to any one of claims 2, 3 and 4, wherein said linkage means comprises a first link rod hingeably connected to one of said non-rotatable members, a second link rod hingeably connected to the other of said non-rotatable members, said first and second link rods being hingeably connected to one another at a common hinge point remote from said handle loom and said blade loom and a third link rod hingeably connected to at least one of said first or second link rods and to said hull or outrigger.

6. A rowing apparatus according to claim 5, wherein said first and second link rods are hingeably connected to said non-rotatable members at substantially equi-distant lengths from said common sweep hinge axis.

7. A rowing apparatus according to claim 5, wherein said first and second link rods are hingeably connected to said non-rotatable members at different lengths from said common sweep hinge axis.

8. A rowing apparatus according to claim 5, wherein said first link rod is hingeably connected to said non-rotatable member on the fore or aft side of said handle loom and wherein said second link rod is hingeable connected to the other of said non-rotatable members on an opposite side of said blade loom.

9. A rowing apparatus according to claim 8, wherein said first and second link rods are hingeably connected to said non-rotatable members by means of bi-directional hinge pin assemblies.

10. A rowing apparatus according to claim 5, wherein said third link rod is hingeably connected to at least one of said first and second link rods and to said hull or outrigger by means of universal hinge pin assemblies.

11. A rowing apparatus according to any one of claims 2, 3 and 4, wherein said linkage means comprises a first link rod hingeably connected to one of said non-rotatable members, a second link rod hingeably connected to the other of said non-rotatable members, said first and second link rods being hingeably connected to a slider, said slider being moveable along a fixed track orientated generally fore and aft of said hull.

12. A rowing apparatus according to claim 11, wherein said track is affixed to said oarlock mainframe.

13. A rowing apparatus according to claim 11, wherein said first and second link rods are hingeably connected to said non-rotatable members at substantially equi-distant lengths from said common sweep hinge axis.

14. A rowing apparatus according to claim 11, wherein said first and second link rods are hingeably connected to said non-rotatable members at different lengths from said common sweep hinge axis.

15. A rowing apparatus according to any one of claims 2, 3 and 4, wherein said coupling device means comprises a pair of swing gears one of each of which is connected to one of said rotatable members, said swing gears being arranged to engage one another with the tangent line of the gear pitch circle of each gear substantially aligned with said common sweep hinge axis.

16. A rowing apparatus according to claim 15, wherein each of said swing gears is approximately a quarter sector of a full gear circle leaving space for receiving a part of the rotatable member of a mating gear thereby increasing the sweep angle of both said handle loom and said blade loom.

17. A rowing apparatus according to any one of claims 2, 3 and 4, wherein said coupling device comprises a universal joint having a first yoke member connected to one of said rotatable members and a second yoke member connected to the other of said rotatable members, a hinge block disposed between said first and second yoke members and a pair of hinge pins extending through said hinge block at substantially right angles to one another, one of said hinge pins extending through said first yoke member and the other of said hinge pins extending through said second yoke member.

18. A rowing apparatus according to any one of claims 2, 3 and 4, wherein said coupling device comprises a pair of universal joints each including a first yoke connected to one of said rotatable members and a second yoke connected to said first yoke by a hinge block and hinge pins, the second yoke of one of said pairs of universal joints having a hollow end while the second yoke of the other of said pairs of universal joints having an end of lesser diameter than said hollow end, said end of lesser diameter slidably fitting inside said hollow end forming a splined slip joint.

19. A rowing apparatus according to any one of claims 2, 3 and 4, wherein said coupling device comprises a linkage assembly composed of a rocker arm pivoted at its center and having opposite ends, a first lever connected at one end to one of said rotatable members, a second lever connected at one end to the other of said rotatable members, a first link rod connected to the other end of said first lever and to an opposite end of said rocker arm and a second link rod connected to the other end of said second lever and to the other opposite end of said rocker arm.

20. A rowing apparatus according to claim 19, wherein said rocker arm is pivotally mounted to a hinge pin connecting said sweep hinge members to said oarlock mainframe along said common sweep axis.

21. A rowing apparatus according to any one of claims 2, 3 and 4, wherein said coupling device comprises a push pull assembly composed of a first lever connected at one end to one of said rotatable members, a second lever connected at one end to the other of said rotatable members, a push pull wire enclosed in an outer flexible casing, said wire having one end connected to the other end of said first lever and its other end connected to the other end of said second lever, and means for securing said outer casing against axial movement along said wire.

22. A rowing apparatus according to claim 1, wherein both said handle loom and said blade loom are rotatable members, said rotatable handle loom being connected to said handle and being supported within a first non-rotatable member and said rotatable blade loom being connected to said blade and being supported by a second non-rotatable member, and wherein said blade feathering means includes a coupling device connecting said rotatable handle loom and said rotatable blade loom for transmitting torque and rotary motion therebetween.

23. A rowing apparatus according to claim 1, wherein one of said handle loom and said blade loom is a rotatable member and the other of said handle blade loom is a non-rotatable member, said one of said rotatable handle loom and said blade loom being connected to one of said handle and said blade and being supported by another non-rotatable member and wherein said blade feathering means includes another rotatable member connected to the other of said handle and said blade and extending along the other of said non-rotatable handle loom and said blade loom and a coupling device connecting said one of said rotatable handle loom and said blade loom and said other rotatable member for transmitting torque therebetween.

24. A rowing apparatus according to claim 3 or 4, wherein at least one of said non-rotatable members is a tubular casing including bearing means for rotatably supporting at least one of said handle loom and said blade loom.

25. A rowing apparatus according to claim 24, wherein said tubular casing is shorter in length than at least said blade loom.

26. A rowing apparatus according to claim 24, wherein said tubular casing has first and second interior surfaces and wherein said rotatable handle loom is provided with at least one exterior surface adapted to engage said first and said second interior surfaces on said tubular casing when said handle loom is rotated, the arrangement being such that said blade is orientated in a plane substantially parallel to the surface of the water when said handle loom is rotated to engage said exterior surface with one of said interior surfaces on said tubular casing and in a plane substantially normal to the surface of the water when said handle loom is rotated to engage said exterior surface with the other of said interior surfaces.

27. A rowing apparatus according to claim 26, wherein said rotatable handle loom is formed with an annular embossment and wherein said exterior surface is a substantially flat surface on said embossment.

28. A rowing apparatus according to claim 26, wherein said rotatable handle loom is connected to one end of an extension shaft rotatably supported within said bearing means by a universal joint, the other end of said shaft being connected to said coupling device.

29. A forwards facing rowing apparatus comprising, in combination: a boat having an elongated hull with fore and aft ends, an outrigger projecting laterally outward from one side of said hull and an oarloom assembly mounted to said outrigger, said oarloom assembly comprising a non-rotatable handle loom having an inboard end and an outboard end, a handle located at said inboard end of said handle loom, a non-rotatable blade loom extending outwardly from said outrigger and having an inner end and an outer end, a blade located at said outer end of said blade loom, an oarlock mainframe hingeably mounted to said outrigger for rotation about an axis orientated generally fore and aft of said hull, a first sweep hinge member affixed to the outboard end of said handle loom, a second sweep hinge member affixed to the inner end of said blade loom, means for mounting said first and second sweep hinge members for rotation about a common sweep axis extending through said oarlock mainframe and orientated in a generally perpendicular relationship with respect to said axis of rotation of said mainframe, linkage means connected to said non-rotatable handle loom and blade loom for synchronizing the motion of said blade loom with that of said handle loom whereby said blade loom is constrained to move in the same direction as that of said handle loom when said handle loom is rotated about said common sweep axis, a first torque shaft connected to said handle and extending along said handle loom, a second torque shaft connected to said blade and extending along said blade loom, and a pair of swing gears one of each of which is connected to said first and second torque shafts, said swing gears being arranged to engage one another with the tangent line of the gear pitch circle of each gear substantially aligned with said common sweep hinge axis, the arrangement being such that when said handle is rotated said blade is rotated in a reverse direction thereby changing the angle of incidence of said blade with respect to the surface of the water floating said hull.

30. A rowing apparatus according to claim 29, wherein said first and second torque shafts are mounted coaxially within said handle loom and said blade loom.

31. A rowing apparatus according to claim 29, wherein said linkage means comprises a first link rod hingeably connected to said non-rotatable handle loom, a second link rod hingeably connected to said non-rotatable blade loom, said first and second link rods being hingeably connected to one another at a common hinge point remote from said handle loom and said blade loom and a third link rod hingeably connected to at least one of said first or second link rods and to said hull or outrigger.

32. A rowing apparatus according to claim 29, wherein said linkage means comprises a first link rod hingeably connected to said non-rotatable handle loom, a second link rod hingeably connected to said non-rotatable blade loom, said first and second link rods being hingeably connected to a slider, said slider being moveable along a fixed track orientated generally fore and aft of said hull.

33. A forwards facing rowing apparatus comprising, in combination: a boat having an elongated hull with fore and aft ends, an outrigger projecting laterally outward from one side of said hull and an oarloom assembly mounted to said outrigger, said oarloom assembly comprising a handle loom having an inboard end and an outboard end, a handle affixed to said inboard end of said handle loom, a blade loom extending outwardly from said outrigger and having an inner end and an outer end, a blade affixed to said outer end of said blade loom, said handle loom being rotatably mounted within a first non-rotatable member and said blade loom being rotatably mounted within a second non-rotatable member, an oarlock mainframe hingeably mounted to said outrigger for rotation about an axis orientated generally fore and aft of said hull, a first sweep hinge member affixed to said first non-rotatable member, a second sweep hinge member affixed to said second non-rotatable member, means for mounting said first and second sweep hinge members for rotation about a common sweep axis extending through said oarlock mainframe and orientated in a generally perpendicular relationship with respect to said axis of rotation of said mainframe, linkage means connected to said first and second non-rotatable members for synchronizing the motion of said blade loom with that of said handle loom whereby said blade loom is constrained to move in the same direction as that of said handle loom when said handle loom is rotated about said common sweep axis, and a pair of swing gears one of each of which is connected to said handle loom and said blade loom, said swing gears being arranged to engage one another with the tangent line of the gear pitch circle of each gear substantially aligned with said common sweep hinge axis, the arrangement being such that when said handle is rotated said blade is rotated in a reverse direction thereby changing the angle of incidence of said blade with respect to the surface of the water floating said hull.

34. A rowing apparatus according to claim 33, wherein said first and second non-rotatable members are tubular casings including bearing means for rotatably supporting said handle loom and said blade loom.

35. A rowing apparatus according to claim 33, wherein said linkage means comprises a first link rod hingeably connected to said first non-rotatable member, a second link rod hingeably connected to said second non-rotatable member, said first and second link rods being hingeably connected to one another at a common hinge point remote from said handle loom and said blade loom and a third link rod hingeably connected to at least one of said first or second link rods and to said hull or outrigger.

36. A rowing apparatus according to claim 33, wherein said linkage means comprises a first link rod hingeably connected to said first non-rotatable member, a second link rod hingeably connected to said second non-rotatable member, said first and second link rods being hingeably connected to a slider, said slider being moveable along a fixed track orientated generally fore and aft of said hull.

* * * * *